US010643633B2

(12) United States Patent
Nakatani et al.

(10) Patent No.: US 10,643,633 B2
(45) Date of Patent: May 5, 2020

(54) SPATIAL CORRELATION MATRIX ESTIMATION DEVICE, SPATIAL CORRELATION MATRIX ESTIMATION METHOD, AND SPATIAL CORRELATION MATRIX ESTIMATION PROGRAM

(71) Applicant: NIPPON TELEGRAPH AND TELEPHONE CORPORATION, Chiyoda-ku (JP)

(72) Inventors: Tomohiro Nakatani, Soraku-gun (JP); Nobutaka Ito, Soraku-gun (JP); Takuya Higuchi, Soraku-gun (JP); Shoko Araki, Soraku-gun (JP); Takuya Yoshioka, Soraku-gun (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 94 days.

(21) Appl. No.: 15/779,926

(22) PCT Filed: Dec. 1, 2016

(86) PCT No.: PCT/JP2016/085821
§ 371 (c)(1),
(2) Date: May 30, 2018

(87) PCT Pub. No.: WO2017/094862
PCT Pub. Date: Jun. 8, 2017

(65) Prior Publication Data

US 2018/0366135 A1 Dec. 20, 2018

(30) Foreign Application Priority Data

Dec. 2, 2015 (JP) ..... 2015-236158

(51) Int. Cl.
*G10L 21/00* (2013.01)
*G10L 21/0232* (2013.01)
*G10L 21/0308* (2013.01)
*G10L 21/0208* (2013.01)

(52) U.S. Cl.
CPC ..... *G10L 21/0232* (2013.01); *G10L 21/0208* (2013.01); *G10L 21/0308* (2013.01)

(58) Field of Classification Search
CPC ..... G10L 19/06; G10L 19/12; G10L 19/032; G10L 19/08; G10L 2019/0016;
(Continued)

(56) References Cited

U.S. PATENT DOCUMENTS 7,155,386 B2 * 12/2006 Gao ..... G10L 19/005 704/216
8,015,003 B2 * 9/2011 Wilson ..... G10L 21/0272 704/226

(Continued)

FOREIGN PATENT DOCUMENTS

JP 2014-90353 5/2014
JP 2014-215544 11/2014

OTHER PUBLICATIONS

Mehrez Souden, et al., "A Multichannel MMSE-Based Framework for Speech Source Separation and Noise Reduction," IEEE Transactions on Audio, Speech, and Language Processing, vol. 21, No. 9, pp. 1913-1928, Sep. 2013.

(Continued)

*Primary Examiner* — Edgar X Guerra-Erazo
(74) *Attorney, Agent, or Firm* — Oblon, McClelland, Maier & Neustadt, L.L.P.

(57) ABSTRACT

An observation feature value vector is calculated based on observation signals recorded at different positions in a situation in which target sound sources and background noise are present in a mixed manner; masks associated with (Continued)

the target sound sources and a mask associated with the background noise are estimated; a spatial correlation matrix of the target sound sources that includes the background noise is calculated based on the masks associated with the observation signals and the target sound sources; a spatial correlation matrix of the background noise is calculated based on the masks associated with the observation signals and the background noise; and a spatial correlation matrix of the target sound sources is estimated based on the matrix obtained by weighting each of the spatial correlation matrices by predetermined coefficients.

12 Claims, 6 Drawing Sheets

(58) Field of Classification Search
CPC ..... G10L 2019/0011; G10L 19/083; G10L 19/125; G10L 19/04; G10L 21/04
See application file for complete search history.

(56) References Cited

U.S. PATENT DOCUMENTS 9,536,538 B2 * 1/2017 Joder ..... G10L 21/0216
2004/0181397 A1 * 9/2004 Gao ..... G10L 19/005 704/207
2005/0222840 A1 * 10/2005 Smaragdis ..... G10L 21/0272 704/204
2006/0277035 A1 * 12/2006 Hiroe ..... G10L 21/0272 704/203
2012/0185246 A1 * 7/2012 Zhang ..... G10L 21/0208 704/226
2015/0262590 A1 * 9/2015 Joder ..... G10L 21/0208 704/201

OTHER PUBLICATIONS

Ozgur Yilmaz et al., "Blind Separation of Speech Mixtures via Time-Frequency Masking," IEEE Transactions on Signal Processing, vol. 52, No. 7, pp. 1830-1847, Jul. 2004.
Dang Hai Tran Vu, et al., "Blind Speech Separation Employing Directional Statistics in an Expectation Maximization Framework," Proc. IEEE Int. Conf. Acoust., Speech, Signal Process. (ICASSP—2010), pp. 241-244, 2010.
Tomohiro Nakatani, et al., "Dominance Based Integration of Spatial and Spectral Features for Speech Enhancement," IEEE Transactions on Audio, Speech, and Language Processing, vol. 21, No. 12, pp. 2516-2531, Dec. 2013.
International Search Report dated Feb. 14, 2017 in PCT/JP2016/085821 filed Dec. 1, 2016.

* cited by examiner

1000
COMPUTER
1120
KEYBOARD
1110
MOUSE
1130
DISPLAY
1050
SERIAL PORT INTERFACE
BUS
1080
1060
VIDEO ADAPTER
1020
CPU
1010
MEMORY
1011
ROM
1012
RAM
1070
NETWORK INTERFACE
1040
DISK DRIVE INTERFACE
1100
DISK DRIVE
1030
HARD DISK DRIVE INTERFACE
1090
HARD DISK DRIVE
1091
OS
1092
APPLICATION PROGRAM
1093
PROGRAM MODULE
1094
PROGRAM DATA

SPATIAL CORRELATION MATRIX ESTIMATION DEVICE, SPATIAL CORRELATION MATRIX ESTIMATION METHOD, AND SPATIAL CORRELATION MATRIX ESTIMATION PROGRAM

FIELD

The present invention relates to a spatial correlation matrix estimation device, a spatial correlation matrix estimation method, and a spatial correlation matrix estimation program.

BACKGROUND

Conventionally, there is a proposed method of estimating, in a situation in which acoustic signals output from target sound sources and acoustic signals due to background noise are present in a mixed manner, from observation signals of sound collected by a plurality of microphones, a spatial correlation matrix in a case where only each of the target sound sources is included in the corresponding observation signals. Furthermore, when estimating the spatial correlation matrix, in some cases, a mask that is the proportion of each of the acoustic signals included in the observed acoustic signals is used.

The spatial correlation matrix is a matrix representing the auto-correlation and the cross-correlation of signals between microphones and is used to, for example, estimate the position of the target sound source or design a beamformer that extracts only the target sound source from the observation signals.

Here, a conventional spatial correlation matrix estimation device will be described with reference to FIG. 6. FIG. 6 is a diagram illustrating the configuration of the conventional spatial correlation matrix estimation device. As illustrated in FIG. 6, first, a time-frequency analysis unit 10*a* calculates an observation feature value vector for each time-frequency point extracted from the observation signals. Then, a mask estimation unit 20*a* estimates the masks associated with the target sound source and the background noise based on the observation feature value vectors. Furthermore, an observation feature value matrix calculation unit 30*a* calculates an observation feature value matrix by multiplying the observation feature value vector by Hermitian transpose of the subject observation feature value vector.

Then, a target sound feature value matrix time average calculation unit 40*a* calculates an average target sound feature value matrix that is the time average of the matrix obtained by multiplying the mask associated with the target sound source by the observation feature value matrix. Furthermore, a noise feature value matrix time average calculation unit 50*a* calculates an average noise feature value matrix that is the time average of the matrix obtained by multiplying the mask associated with the background noise by the observation feature value matrix. Lastly, a target sound feature value noise removal unit 60*a* estimates a spatial correlation matrix of the target sound source by subtracting an average noise feature value matrix from the average target sound feature value matrix.

CITATION LIST

Patent Literature

Non-Patent Literature 1: Mehrez Souden, Shoko Araki, Keisuke Kinoshita, Tomohiro Nakatani, Hiroshi Sawada, "A multichannel MMSE-based framework for speech source separation and noise reduction," IEEE Trans. Audio, Speech, and Language Processing, vol. 21, no. 9, pp. 1913-1928, 2013.

Non-Patent Literature 2: Ozgur Yilmaz, and Scott Rickard, "Blind separation of speech mixture via time-frequency masking," IEEE Trans. Signal Processing, vol. 52, no. 7, pp. 1830-1847, 2004.

Non-Patent Literature 3: Dang Hai Tran Vu and Reinhold Haeb-Umbach, "Blind speech separation employing directional statistics in an expectation maximization framework," Proc. IEEE Int. Conf. Acoust., Speech, Signal Process. (ICASSP-2010), pp. 241-244, 2010.

Non-Patent Literature 4: Tomohiro Nakatani, Shoko Araki, Takuya Yoshioka, Marc Delcroix, and Masakiyo Fujimoto, "Dominance based integration of spatial and spectral features for speech enhancement," IEEE Transactions on Audio, Speech, and Language Processing, vol. 21, no. 12, pp. 2516-2531, December 2013.

SUMMARY

Technical Problem

However, with the conventional estimation method of the spatial correlation matrix, because the effect of background noise is not accurately removed from the observation signals, there is a problem in that, in some cases, a spatial correlation matrix of the target sound source is not able to be estimated with high accuracy.

For example, in the conventional estimation method of the spatial correlation matrix, the result obtained by subtracting the average noise feature value matrix from the average target sound feature value matrix is estimated as the spatial correlation matrix of the target sound sources; however, this method is experimentally obtained and an amount of effect of noise included in the average target sound feature value matrix does not always match the average noise feature value matrix; therefore, there is no guarantee that the effect of noise is canceled. Thus, in the conventional estimation method of the spatial correlation matrix, there may be a case in which a spatial correlation matrix of a target sound source is not estimated with high accuracy.

Solution to Problem

To solve a problem and to achieve an object, a spatial correlation matrix estimation device that estimates, in a situation in which N first acoustic signals associated with N target sound sources (where, N is an integer equal to or greater than 1) and a second acoustic signal associated with background noise are present in a mixed manner, based on observation feature value vectors calculated based on M observation signals (where, M is an integer equal to or greater than 2) each of which is recorded at a different position, a first mask that is the proportion of the first acoustic signal included in a feature value of the observation signal for each time-frequency point and a second mask that is the proportion of the second acoustic signal included in a feature value of the observation signal for each time-frequency point and that estimates a spatial correlation matrix of the target sound sources based on the first mask and the second mask, the spatial correlation matrix estimation device includes: a noise removal unit that estimates the spatial correlation matrix of the target sound sources based on a first spatial correlation matrix obtained by weighting, by a first coefficient, a first feature value matrix calculated based on the observation signals and the first masks and based on a second spatial correlation matrix obtained by weighting, by a second coefficient, a second feature value matrix calculated based on the observation signals and the second masks.

A spatial correlation matrix estimation method for estimating, in a situation in which N first acoustic signals associated with N target sound sources (where, N is an integer equal to or greater than 1) and a second acoustic signal associated with background noise are present in a mixed manner, based on observation feature value vectors calculated based on M observation signals (where, M is an integer equal to or greater than 2) each of which is recorded at a different position, a first mask that is the proportion of the first acoustic signal included in a feature value of the observation signal for each time-frequency point and a second mask that is the proportion of the second acoustic signal included in a feature value of the observation signal for each time-frequency point and estimating a spatial correlation matrix of the target sound sources based on the first mask and the second mask, the spatial correlation matrix estimation method includes: a noise removal step of estimating the spatial correlation matrix of the target sound sources based on a first spatial correlation matrix obtained by weighting, by a first coefficient, a first feature value matrix calculated based on the observation signals and the first masks and based on a second spatial correlation matrix obtained by weighting, by a second coefficient, a second feature value matrix calculated based on the observation signals and the second masks.

Advantageous Effects of Invention

According to the present invention, it is possible to accurately remove the effect of background noise from observation signals and estimate a spatial correlation matrix of target sound sources with high accuracy.

DESCRIPTION OF EMBODIMENTS

Preferred embodiments of a spatial correlation matrix estimation device, a spatial correlation matrix estimation method, and a spatial correlation matrix estimation program according to the present application will be described in detail below with reference to the accompanying drawings. The present invention is not limited to the embodiments.

[a] First Embodiment

First, the configuration, the flow of a process, and effects of the spatial correlation matrix estimation device according to the first embodiment will be described. Furthermore, in the first embodiment, it is assumed that, in a situation in which N first acoustic signals associated with N target sound sources (where, N is an integer equal to or greater than 1) and a second acoustic signal associated with background noise are present in a mixed manner, M observation signals (where, M is an integer equal to or greater than 2) each of which is recorded at a different position are input to the spatial correlation matrix estimation device.

Configuration of the First Embodiment

Figure 1:
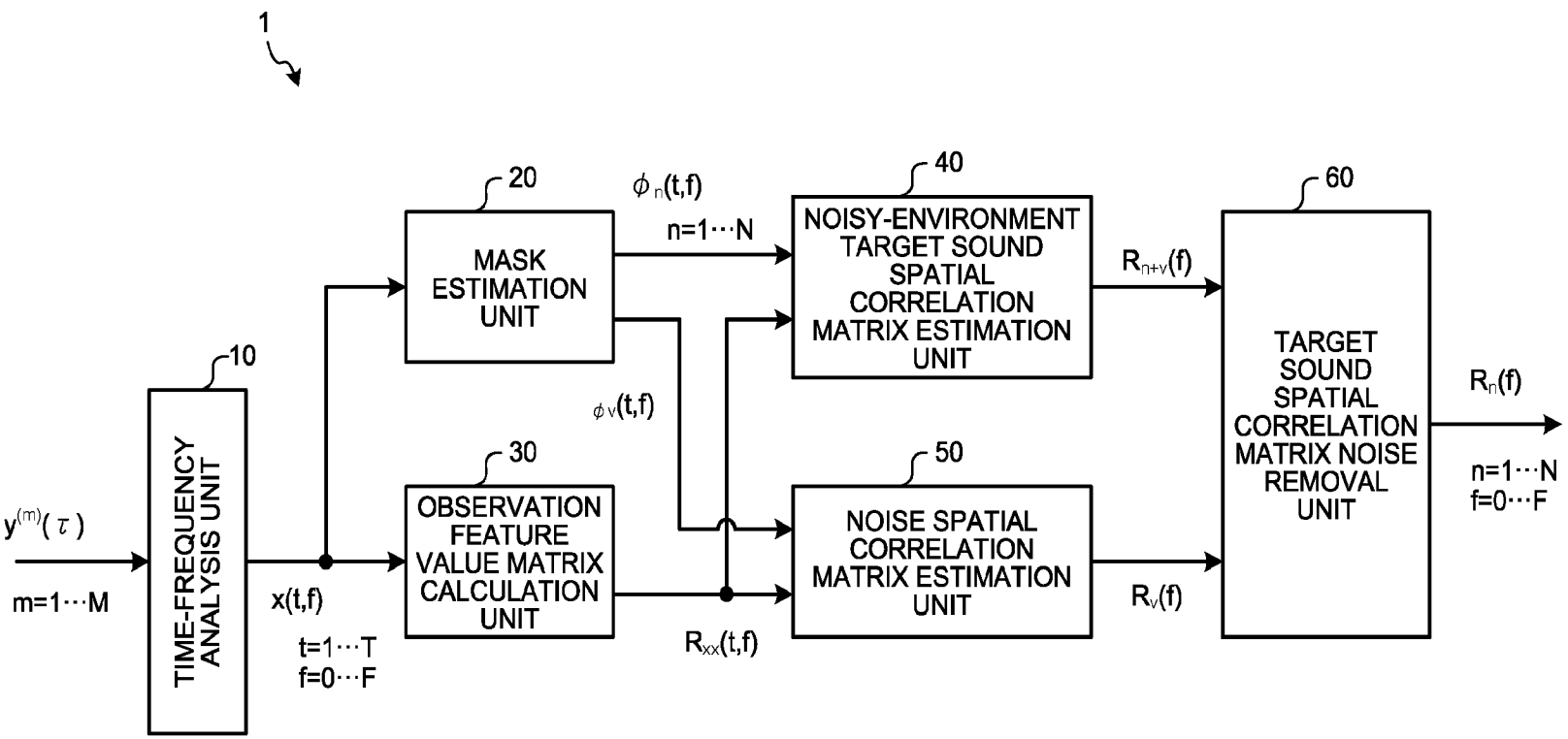
FIG. 1 is a diagram illustrating an example of the configuration of a spatial correlation matrix estimation device according to a first embodiment.

The configuration of the first embodiment will be described with reference to FIG. 1. FIG. 1 is a diagram illustrating an example of the configuration of the spatial correlation matrix estimation device according to the first embodiment. As illustrated in FIG. 1, a spatial correlation matrix estimation device 1 includes a time-frequency analysis unit 10, a mask estimation unit 20, an observation feature value matrix calculation unit 30, a noisy-environment target sound spatial correlation matrix estimation unit 40, a noise spatial correlation matrix estimation unit 50, and a target sound spatial correlation matrix noise removal unit 60.

First, the outline of each of the units in the spatial correlation matrix estimation device 1 will be described. The time-frequency analysis unit 10 calculates observation feature value vectors based on observation feature values that have been input. Specifically, the time-frequency analysis unit 10 applies a short-time signal analysis to each of observation signals $y^{(m)}(\tau)$; extracts a signal feature value for each time-frequency point; and calculates, for each time-frequency point, an observation feature value vector x(t,f) that is an M-dimensional column vector formed by signal feature values as components.

Furthermore, the mask estimation unit 20 estimates a first mask $\phi_n(t,f)$ that is the proportion of the first acoustic signal included in the feature value of the observation signal for each time-frequency point and estimates a second mask $\phi_v(t,f)$ that is the proportion of the second acoustic signal included in the feature value of the observation signal for each time-frequency point. Then, the observation feature value matrix calculation unit 30 calculates, based on the observation feature value vector, for each time-frequency point, an observation feature value matrix $R_{xx}(t,f)$ by multiplying the observation feature value vector by Hermitian transpose of the observation feature value vector.

The noisy-environment target sound spatial correlation matrix estimation unit 40 calculates a first spatial correlation matrix obtained by weighting, by a first coefficient, a first feature value matrix calculated based on the observation signals and the first masks. Specifically, regarding each of the target sound sources, the noisy-environment target sound spatial correlation matrix estimation unit 40 calculates the time average, for each frequency, of the matrix obtained by multiplying, for each time-frequency point, the observation feature value matrix by the first mask as a first feature value matrix $R'_{n+v}(t,f)$ and sets the result obtained by multiplying the first coefficient $\alpha$ by the first feature value matrix to a first spatial correlation matrix $R_{n+v}(t,f)$.

The noise spatial correlation matrix estimation unit 50 calculates a second spatial correlation matrix obtained by weighting, by a second coefficient, a second feature value matrix calculated based on the observation signals and the second masks. Specifically, regarding the background noise, the noise spatial correlation matrix estimation unit 50 calculates the time average, for each frequency, of the matrix obtained by multiplying, for each time-frequency point, the observation feature value matrix by the second mask as a second feature value matrix $R'_v(t,f)$ and sets the result obtained by multiplying the second coefficient β by the second feature value matrix to a second spatial correlation matrix $R_v(t,f)$.

The target sound spatial correlation matrix noise removal unit 60 that functions as a noise removal unit estimates a spatial correlation matrix of the target sound sources based on the first spatial correlation matrix and the second spatial correlation matrix. Specifically, the target sound spatial correlation matrix noise removal unit 60 sets the result obtained by subtracting the second spatial correlation matrix from the first spatial correlation matrix to a spatial correlation matrix $R_n(t,f)$ of the target sound sources. Furthermore, the ratio of the first coefficient to the second coefficient is equal to the ratio of, for example, the reciprocal of the time average value of the first mask to the reciprocal of the time average value of the second mask.

In the following, details of the units in the spatial correlation matrix estimation device 1 will be described. The target sound sources have sparse properties and it is assumed that only a single target sound source is present in each time-frequency point. Furthermore, it is assumed that background noise is present in all of the time-frequency points. Consequently, the observation feature value vector that is calculated by the time-frequency analysis unit 10 using a short-time signal analysis, such as short-time Fourier transformation, from the input observation feature value matches either Equation (1) or Equation (2).

$$x(t,f)=s_n(t,f)+v(t,f) \tag{1}$$

$$x(t,f)=v(t,f) \tag{2}$$

where, t and f in Equation (1) and Equation (2) denote the time and the frequency number, respectively, and it is assumed that t takes an integer of 1 to T and f takes an integer of 0 to F.

Here, Equation (1) indicates the case where only an $n^{th}$ sound source included in the target sound sources is present at the subject time-frequency point; Equation (2) indicates the case where no target sound source is present; and $s_n(t,f)$ and v(t,f) are obtained by resolving the observation feature value vector into the sum of the component of the target sound source n and the component of the background noise.

The mask estimation unit 20 estimates a mask by using a known mask estimation technology. The mask estimated about the $n^{th}$ target sound source by the mask estimation unit 20 is referred to as $\phi_n(t,f)$ and the mask estimated about the background noise is referred to as $\phi_v(t,f)$. Hereinafter, the subscript n is referred to as the number indicating that which target sound source is associated and the subscript v is the symbol indicating that the subject is associated with noise.

The noisy-environment target sound spatial correlation matrix estimation unit 40 calculates the first feature value matrix associated with the $n^{th}$ target sound source, i.e., an average target sound feature value matrix $R'_{n+v}(f)$, by using Equation (3).

$$R'_{n+v}(f) = \frac{1}{T}\sum_{t=1}^{T} \phi_n(t, f)R_{xx}(t, f) \tag{3}$$

Furthermore, the noise spatial correlation matrix estimation unit 50 calculates the second feature value matrix associated with the background noise, i.e., an average noise feature value matrix $R'_v(f)$, by using Equation (4).

$$R'_v(f) = \frac{1}{T}\sum_{t=1}^{T} \phi_v(t, f)R_{xx}(t, f) \tag{4}$$

Here, the observation feature value matrix $R_{xx}(t,f)$ is represented by Equation (5). Furthermore, H in Equation (5) denotes Hermitian transpose of the matrix.

$$R_{xx}(t,f)=x(t,f)x^H(t,f) \tag{5}$$

As indicated by Equation (1) and Equation (2), because the background noise is included in all of the time-frequency points, the effect of the noise is also consequently included in $R'_{n-v}(f)$. The subscript n+v of $R'_{n+v}(f)$ indicates that both effects of the target sound source n and the noise are included in $R'_{n+v}(f)$.

Here, if it is possible to obtain a spatial correlation matrix by collecting only the time-frequency points associated with Equation (1), the obtained spatial correlation matrix is a matrix in which only the effects of the target sound source n and the background noise are included. In contrast, the spatial correlation matrix of the background noise can be obtained by calculating the spatial correlation matrix by collecting only the time-frequency points associated with Equation (2).

Thus, in a conventional spatial correlation matrix estimation method, as indicated by Equation (6), a spatial correlation matrix of the target sound sources is obtained by calculating a difference between the obtained spatial correlation matrices.

$$R'_n(f)=R'_{n+v}(f)-R'_v(f) \tag{6}$$

In contrast, in the first embodiment according to the present invention, a difference is obtained by further weighting these spatial correlation matrices. Here, if each of the target sound sources and the background noise are uncorrelated, $R_{xx}(t,f)$ is represented by Equation (7).

$$x(t, f)x^H(t, f) = \sum_{n=1}^{N} s_n(t, f)s_n^H(t, f) + v(t, f)v^H(t, f) \tag{7}$$

In Equation (7), considering that the component derived from background noise is $v(t,f)v^H(t,f)$ and also considering Equation (3) and Equation (4), the component derived from the remaining background noise in Equation (6) is represented by Equation (8).

$$R'_0(f) = \frac{1}{T}\sum_{t=1}^{T} (\phi_n(t, f) - \phi_v(t, f))v(t, f)v^H(t, f) \tag{8}$$

Consequently, in the case where the value obtained by Equation (8) becomes zero, it can be said that the effect of the background noise remaining in the estimation value of the spatial correlation matrix of the target sound sources becomes zero. Thus, the target sound spatial correlation matrix noise removal unit 60 calculates, as indicated by Equation (9), the spatial correlation matrix of the target sound sources by using the first spatial correlation matrix weighted by the first coefficient α, i.e., the average target sound feature value matrix $R'_{n+v}(f)$ and by using the second spatial correlation matrix weighted by the second coefficient β, i.e., the average noise feature value matrix $R'_v(t,f)$.

$$R_n(f)=\alpha R'_{n+v}(f)-\beta R'_v(f) \tag{9}$$

Furthermore, $R_{n+v}(f)$ obtained by weighting $R'_{n|v}(f)$ by the first coefficient α is calculated by the noisy-environment target sound spatial correlation matrix estimation unit 40, whereas $R_v(f)$ obtained by weighting $R'_v(f)$ by the second coefficient β is calculated by the noise spatial correlation matrix estimation unit 50.

At this time, the component derived from the background noise remaining in the estimation value of the spatial correlation matrix of the target sound sources in Equation (9) is represented by Equation (10).

$$R_0(f)=\frac{1}{T}\sum_{t=1}^{T}(\alpha\phi_n(t,f)-\beta\phi_v(t,f))v(t,f)v^H(t,f) \tag{10}$$

A necessary and sufficient condition for the value obtained by Equation (10) corresponding to zero is that Equation (11) is satisfied.

$$\alpha=\beta\frac{\sum_t \phi_n(t,f)v(t,f)v^H(t,f)/\sum_t \phi_n(t,f)}{\sum_t \phi_v(t,f)v(t,f)v^H(t,f)/\sum_t \phi_v(t,f)}\cdot\frac{\sum_t \phi_v(t,f)}{\sum_t \phi_n(t,f)} \tag{11}$$

In Equation (11), $\Sigma_t\phi_n(t,f)v(t,f)v^H(t,f)/\Sigma_t\phi_n(t,f)$ and $\Sigma_t\phi_v(t,f)v(t,f)v^H(t,f)/\Sigma_t\phi_v(t,f)$ are obtained by calculating the weighted time average of the noise feature value matrix $v(t,f)v^H(t,f)$ by using different weights. At this time, if it is assumed that the spatial correlation matrix of the background noise is not significantly changed in terms of time, it can be said that these two weighted time average values are approximately matched. Consequently, Equation (11) can further be rewritten to Equation (12).

$$\alpha=\beta\frac{\sum_t \phi_v(t,f)}{\sum_t \phi_n(t,f)} \tag{12}$$

Then, Equation (13) is obtained based on Equation (12) and Equation (9).

$$R_n(f)=c\left(\frac{T}{\sum_t \phi_n(t,f)}R'_{n+v}(f)-\frac{T}{\sum_t \phi_v(t,f)}R'_v(f)\right) \tag{13}$$

In Equation (13), it is assumed that $T/\Sigma_t\phi_n(t,f)$ denotes the reciprocal of the time average of the mask associated with the target sound source n, $T/\Sigma_t\phi_v(t,f)$ denotes the reciprocal of the time average of the mask associated with background noise, and c denotes a scalar constant. c is a constant determined depending on the time section that is used to obtain the spatial correlation matrix of the target sound sources. In a case of all time sections, $c=\Sigma_t\phi_n(t,f)/T$ is used and if the time section in which the target sound source n is mainly present is used for the calculation, c=1 is used.

In the case of $c=\Sigma_t\phi_n(t,f)/T$, this corresponds to a case of α=1 in Equation (9) and corresponds to the case in which, in Equation (6), the effect of noise is removed by only changing the gain of $R'_v(f)$ without changing the gain of the spatial correlation matrix related to the target sound sources.

If Equation (13) is further arranged together with Equation (3) and Equation (4), Equations (14) to (16) are obtained.

$$R_{n+v}(f)=\frac{\sum_{t=1}^{T}\phi_n(t,f)R_{xx}(t,f)}{\sum_{t=1}^{T}\phi_n(t,f)} \tag{14}$$

$$R_v(f)=\frac{\sum_{t=1}^{T}\phi_v(t,f)R_{xx}(t,f)}{\sum_{t=1}^{T}\phi_v(t,f)} \tag{15}$$

$$R_n(f)=c(R_{n+v}(f)-R_v(f)) \tag{16}$$

For example, when c=1, Equation (16) is represented by Equation (17). In this way, by obtaining a difference after multiplying an appropriate coefficient under the assumption that the spatial correlation matrix of the background noise is not significantly changed in terms of time, it is possible to estimate the spatial correlation matrix in which the effect of the background noise related to the $n^{th}$ target sound source is accurately removed.

$$R_n(f)=R_{n+v}(f)-R_v(f) \tag{17}$$

Equation (14) corresponds to the process in which the noisy-environment target sound spatial correlation matrix estimation unit 40 estimates a noisy-environment target sound spatial correlation matrix $R_{n+v}(f)$. Furthermore, Equation (15) corresponds to the process in which the noise spatial correlation matrix estimation unit 50 estimates a noise spatial correlation matrix $R_v(f)$. Furthermore, Equation (16) corresponds to the process in which the target sound spatial correlation matrix noise removal unit 60 estimates the spatial correlation matrix $R_n(f)$ of the target sound.

Furthermore, when the number of sound source N=1, if c is defined as indicated by Equation (18), the spatial correlation matrix of the target sound source may also be calculated by Equations (19) to (21).

$$c=\sum_t \phi_n(t,f)/T \tag{18}$$

$$R''_{n+v}(f)=\frac{1}{T}\sum_{t=1}^{T}R_{xx}(t,f) \tag{19}$$

$$R''_v(f)=\frac{\sum_{t=1}^{T}\phi_v(t,f)R_{xx}(t,f)}{\sum_{t=1}^{T}\phi_v(t,f)} \tag{20}$$

$$R''_n(f)=R''_{n+v}(f)-R''_v(f) \tag{21}$$

In Equations (19) to (21), because a mask $\phi_n(t,f)$ of the target sound source is not used, it can be said that it is possible to estimate the spatial correlation matrix of the target sound sources without estimating the mask of the target sound source. In this case, as indicated by Equation (19), when N=1, the noisy-environment target sound spatial correlation matrix is the time average, for each frequency, of the observation feature value matrix.

The mask estimation unit 20 models, for each frequency, a probability distribution of the observation feature value vectors by a mixture distribution composed of N+1 component distributions each of which is a zero mean M-dimensional complex Gaussian distribution with a covariance matrix represented by the product of a scalar parameter that has a time varying value and a positive definite Hermitian matrix that has time invariant parameters as its elements. Then, the mask estimation unit 20 sets, to the first mask and the second mask, each of posterior probabilities of the component distributions obtained by estimating the parameters of the mixture distributions such that the mixture distributions approach the distribution of the observation feature value vectors.

Consequently, even in the case where the shape of the distribution of the observation feature value vectors is not able to accurately be approximated on a circle on a hypersphere, the mask estimation unit 20 accurately approximates the shape of the distribution and performs precise mask estimation.

If the component distribution associated with the probability density function of the observation feature value vector of the time-frequency point in which the target sound source n is present is denoted by $p_n(x(t,f);\Theta)$ and the component distribution associated with the probability density function of the observation feature value vector of the time-frequency point in which only noise is present is denoted by $p_v(x(t,f);\Theta)$, the mask estimation unit 20 performs modeling each of the component distributions such as that indicated by Equation (22) and Equation (23).

$$p_n(x(t,f);\Theta)=N_c(x(t,f);0,r_n(t,f)B_n(f)) \tag{22}$$

$$p_v(x(t,f);\Theta)=N_c(x(t,f);0,r_v(t,f)B_v(f)) \tag{23}$$

where, $N_c(x;\mu, \Sigma)$ is an M-dimensional complex Gaussian distribution with a mean vector $\mu$ and a covariance matrix $\Sigma$. In the equation of component distributions indicated by Equation (22) and Equation (23), $r_n(t,f)$ and $r_v(t,f)$ are scalar parameters associated with the magnitude of each of the acoustic signals and are set to take a different value for each time-frequency point.

In contrast, $B_n(f)$ and $B_v(f)$ are matrices each of which indicates the spatial arrival direction of the acoustic signal and is defined as the matrix that has the time invariant parameters as elements. $B_n(f)$ and $B_v(f)$ are parameters that determine the shape of the component distribution and, in the model described above, constraints are not particularly set. Consequently, each of the component distributions can have any shape that can be represented by the M-dimensional complex Gaussian distribution and is not limited to the distribution of a circle on a hypersphere.

Furthermore, $\Theta=\{r_n(t,f), r_v(t,f), B_n(f), B_v(f), \lambda_n(f), \lambda_v(f)\}$ represents a set of model parameters of the mixture distribution formed by using the complex Gaussian distribution as the component distribution. $\lambda n(f)$ and $\lambda v(f)$ are a mixing ratio of the component distribution associated with the time-frequency points in each of which the target sound source n is present and a mixing ratio of the component distribution associated with the time-frequency points in each of which only the background noise is present and satisfy the conditions of $\Sigma_n\lambda_n(f)+\lambda_v(f)=1$, $1>\lambda_n(f)>0$, and $1>\lambda_v(f)>0$. Furthermore, the mixture distribution formed of the component distribution described above is represented by Equation (24).

$$p(x(t,f);\Theta)=\sum_n^N \lambda_n(f)p_n(x(t,f);\Theta)+\lambda_v(f)P_v(x(t,f);\Theta) \tag{24}$$

The mask estimation unit 20 models the observation feature value vectors at all of the time-frequency points by using the mixture model described above and estimates each of the model parameters such that the mixture distribution described above approaches the probability distribution of the observation feature value vectors.

After the model parameter has been estimated, the mask estimation unit 20 estimates the mask associated with each of the target sound source n and the background noise as the posterior probability distribution of each of the component distributions by using Equation (25) or Equation (26).

$$\phi_n(t,f)=\frac{\lambda_n(f)p_n(x(t,f);\Theta)}{\sum_n \lambda_n(f)p_n(x(t,f);\Theta)+\lambda_v(f)p_v(x(t,f);\Theta)} \tag{25}$$

$$\phi_v(t,f)=\frac{\lambda_v(f)p_v(x(t,f);\Theta)}{\sum_n \lambda_n(f)p_n(x(t,f);\Theta)+\lambda_v(f)p_v(x(t,f);\Theta)} \tag{26}$$

Because each of the component distributions can have any shape in the range of the M-dimensional complex Gaussian distribution, even if the shape of the distribution of the observation feature value vectors is not accurately approximated on a circle on a hypersphere, it is possible to accurately approximate the shape of each of the component distributions.

Incidentally, in general, an acoustic signal associated with each of the target sound sources n has a property of mainly arriving from the direction (sound source direction) in which the sound source is present viewed from the position of a microphone. Consequently, the positive definite Hermitian matrix of the component distribution associated with the target sound sources n has a property of having the maximum eigenvalue in a subspace associated with the direction of the sound source and having a relatively small value regarding an eigenvalue of a subspace other than the above described subspace.

In contrast, because the sound of background noise usually arrives from all directions, regarding the positive definite Hermitian matrix of the component distribution associated with the background noise, the components of the matrix are dispersed in the subspace associated with every direction. Consequently, a state in which eigenvalues are biased in a specific subspace is less likely to occur.

Thus, the mask estimation unit 20 further sets, from among the component distributions, the posterior probability of the component distribution that has the most flat shape of the distribution of the eigenvalues of the positive definite Hermitian matrix that has the time invariant parameters as elements to the second mask associated with the background noise. Consequently, the mask estimation unit 20 can automatically estimate which mask is associated with the background noise from among the estimated masks.

Example 1

The first embodiment will be described by using specific examples. First, in a case of N=1, regarding, for example, the voice spoken by a single person recorded by mikes the number of which is equal to or greater than M=2 in a background noise environment, the spatial correlation matrix estimation device 1 estimates a spatial correlation matrix from which the effect of noise is removed. Furthermore, in a case of N>1, regarding, for example, a conversation held by N persons recorded by microphones the number of which is M>1, the spatial correlation matrix estimation device 1 estimates the spatial correlation matrix from which the effect of the noise is removed.

Here, the observation signals recorded by the microphone m are referred to as $y^{(m)}(\tau)$. Because $y^{(m)}(\tau)$ is formed by the sum of the acoustic signal $z_n^{(m)}(\tau)$ derived from each of the sound source signals n and the acoustic signal $u^{(m)}(\tau)$ derived from the background noise, observation signals are modeled such as that indicated by Equation (27).

$$y^{(m)}(\tau) = \sum_{n=1}^{N} z_n^{(m)}(\tau) + u^{(m)}(\tau) \tag{27}$$

The time-frequency analysis unit 10 receives the observation signals described above recorded by all of the microphones, applies the short-time signal analysis for each of the observation signals $y^{(m)}(\tau)$, and obtains the signal feature value $x^{(m)}(t,f)$ for each time-frequency. Regarding the short-time signal analysis, various methods, such as a short-time discrete Fourier transformation or short-time discrete cosine transformation, may be used.

The time-frequency analysis unit 10 further uses the signal feature value $x^{(m)}(t,f)$ obtained from each time-frequency as the collected vectors related to all of the microphones, and forms the observation feature value vector x(t,f) represented by Equation (28).

$$x(t, f) = \begin{bmatrix} X^{(1)}(t, f) \\ X^{(2)}(t, f) \\ \vdots \\ X^{(M)}(t, f) \end{bmatrix} \tag{28}$$

Then, the observation feature value matrix calculation unit 30 receives the observation feature value vector x(t,f) and obtains, for each time-frequency point, the observation feature value matrix $R_{xx}(t,f)$ by using Equation (29).

$$R_{xx}(t,f)=x(t,f)x^H(t,f) \tag{29}$$

Furthermore, the mask estimation unit 20 receives the observation feature value vector x(t,f) and estimates, for each time-frequency point, as the value of a mask, the proportion of each of the target sound sources mixed with the background noise. Furthermore, as indicated by Equation (30), it is assumed that, at the time-frequency point, the sum total of the masks related to all of the target sound sources and the background noise becomes one.

$$\Sigma_{n=1}^{N}\phi_n(t,f)+\phi_v(t,f)=1 \tag{30}$$

The noisy-environment target sound spatial correlation matrix estimation unit 40 receives the estimation value $\phi_n(t,f)$ of the mask related to each of the target sound sources and the observation feature value matrix $R_{xx}(t,f)$ and calculates, for each frequency f, the noisy-environment target sound spatial correlation matrix $R_{n+v}(f)$ of each of the target sound sources n such as that indicated by Equation (31).

$$R_{n+v}(f) = \frac{\sum_{t=1}^{T} \phi_n(t, f) R_{xx}(t, f)}{\sum_{t=1}^{T} \phi_n(t, f)} \tag{31}$$

The noise spatial correlation matrix estimation unit 50 receives the estimation value $\phi_v(t,f)$ of the mask related to the background noise and the observation feature value matrix $R_{xx}(t,f)$ and calculates, for each frequency f, the noise spatial correlation matrix $R_v(f)$ of each of the target sound sources n such as that indicated by Equation (32).

$$R_v(f) = \frac{\sum_{t=1}^{T} \phi_v(t, f) R_{xx}(t, f)}{\sum_{t=1}^{T} \phi_v(t, f)} \tag{32}$$

The target sound spatial correlation matrix noise removal unit 60 receives the estimation value $R_{n+v}(f)$ of the noisy-environment target sound spatial correlation matrix and an estimated value $R_v(f)$ of the noise spatial correlation matrix and calculates, for each frequency f, the spatial correlation matrix $R_n(t)$ of the target sound by using Equation (33).

$$R_n(f)=R_{n+v}(f)-R_v(f) \tag{33}$$

The obtained spatial correlation matrices can be used for various purposes. For example, the eigenvector associated with the maximum eigenvalue of the spatial correlation matrix of the target sound source n matches a steering vector that represents a space transfer property between the target sound source n and microphones. Furthermore, based on the steering vector $h_n(f)$ estimated in this way and based on the spatial correlation matrix $R_x(f)$ of the observation signals themselves indicated by Equation (34), a minimum variance distortionless response (MVDR) filter $w_n(f)$ can be obtained such as that indicated by Equation (35).

$$R_x(f) = \sum_{t=1}^{T} R_{xx}(t, f)/T \tag{34}$$

$$w_n(f) = \frac{R_x^{-1}(f)h_n(f)}{h_n^H(f)R_x^{-1}(f)h_n(f)} \tag{35}$$

By applying this MVDR filter to the observation feature value vector x(t,f), it is possible to suppress the components of the sound sources other than the target sound source n and the component of the background noise and obtain, as indicated by Equation (36), the estimation value $s_n(t,f)$ of the signal feature value associated with the target sound source n.

$$s_n(t,f)=h_n^H(f)x(t,f) \tag{36}$$

Furthermore, if the spatial correlation matrix $R_n(f)$ of the target sound source n and the spatial correlation matrix $R_x(f)$ of the observation signals have been obtained, a multi-channel Wiener filter $W_n(f)$ can be formed such as that indicated by Equation (37).

$$W_n(f)=R_x^{-1}(f)R_n(f) \tag{37}$$

By applying this multi-channel Wiener filter $W_n(f)$ to the observation feature value vector x(t,f), it is possible to suppress the components of the sound sources other than the target sound source n and the component of the background noise and obtain, as indicated by Equation (38), the estimation value $s_n(t,f)$ of the feature value vector associated with the target sound source n.

$$s_n(t,f)=W_n^H(f)x(t,f) \tag{38}$$

Example 2

Figure 2:
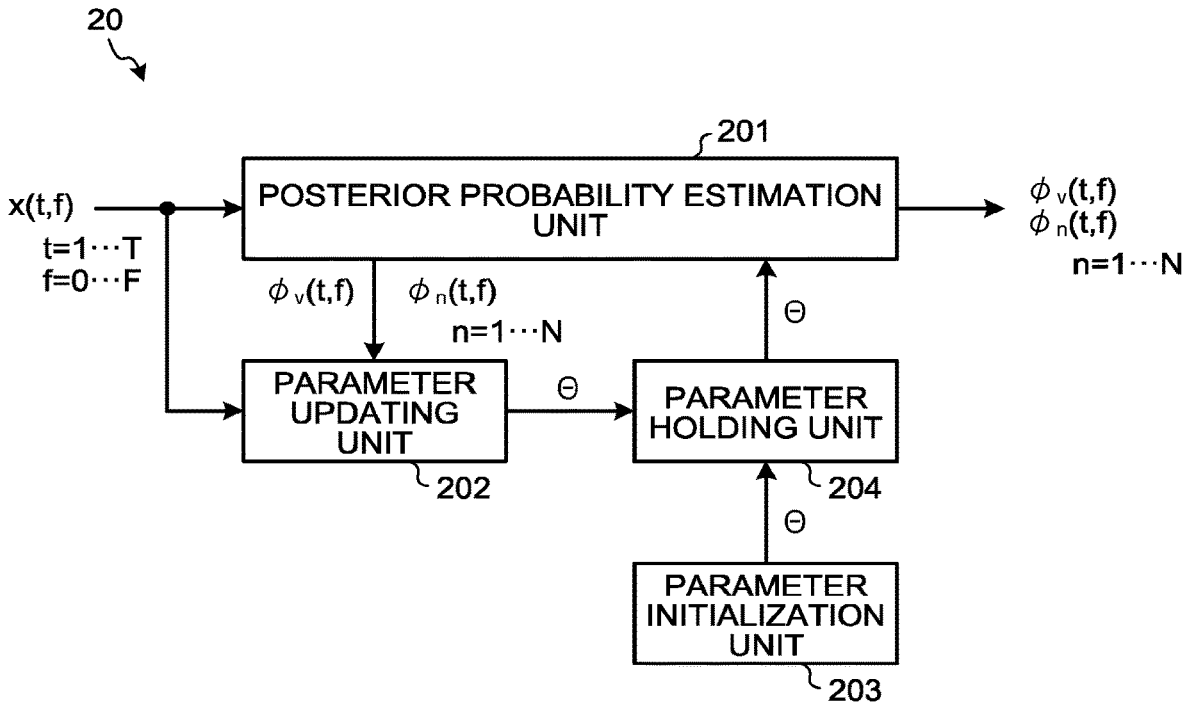
FIG. 2 is a diagram illustrating an example of the configuration of a mask estimation unit in the spatial correlation matrix estimation device according to the first embodiment.

In the following, specific examples of the mask estimation unit 20 will be described with reference to FIG. 2. FIG. 2 is a diagram illustrating an example of the configuration of the mask estimation unit in the spatial correlation matrix estimation device according to the first embodiment. The mask estimation unit 20 estimates a mask by modeling a probability distribution of the observation feature value vectors by using a complex Gaussian mixture distribution.

First, regarding a generative distribution of the observation signal x(t,f) at each frequency f, the mask estimation unit 20 performs modeling by using the complex Gaussian mixture distribution such as that indicated by Equation (39).

$$p(x(t,f);\Theta)=\Sigma_n^N\lambda_n(f)p_n(x(t,f);\Theta)+\lambda_v(f)p_v(x(t,f);\Theta)$$

$$p_n(x(t,f);\Theta)=N_c(x(t,f);0,r_n(t,f)B_n(f))$$

$$p_v(x(t,f);\Theta)=N_c(x(t,f)0;r_v(t,f)B_v(f)) \tag{39}$$

Here, $\Theta=\{\lambda_n(f), \lambda_v(f), r_n(t,f), r_v(t,f), B_n(f), B_v(f)\}$ is a parameter set of the complex Gaussian mixture distribution. $\lambda_n(f)$ and $\lambda_v(f)$ are the parameters representing the mixture weight of the complex Gaussian distribution associated with each of the $n^{th}$ sound source and the background noise and satisfy Equation (40). $r_n(t,f)$ and $r_v(t,f)$ are scalar parameters each representing the expected value of the power of each of the $n^{th}$ sound source and the background noise at each time-frequency point (t,f).

$$\Sigma_n\lambda_n(f)+\lambda_v(f)=1 \tag{40}$$

$B_n(f)$ and $B_v(f)$ are time invariant spatial correlation matrices of the $n^{th}$ sound source and the background noise each of which is normalized by power. Here, $B_n(f)$ and $B_v(f)$ become parameters for determining distributions of the observation feature value vectors; however, by obtaining each of the parameters as a matrix of full rank, it is possible to more accurately approximate the distribution of the observation feature value vectors even in a case where approximation is not accurately be able to perform on a circle on a hypersphere.

A posterior probability estimation unit 201 estimates a mask by obtaining, based on the probability distribution expressed by Equation (39), a probability that the observation signal x(t,f) occurs from each of the component distributions. First, a parameter initialization unit 203 sets the initial value of each of the parameters and holds the set initial values in a parameter holding unit 204. The parameter initialization unit 203 determines the initial value of the parameter based on, for example, random numbers.

Then, the posterior probability estimation unit 201 calculates, by using input data (observation signals) and the current distribution parameters, a posterior probability related to each of the component distributions such as that indicated by Equation (41) and Equation (42). The posterior probability calculated here corresponds to the mask of each frequency point.

$$\phi_n(t,f)=\frac{\lambda_n(f)p_n(x(t,f);\Theta)}{\sum_n\lambda_n(f)p_n(x(t,f);\Theta)+\lambda_v(f)p_v(x(t,f);\Theta)} \tag{41}$$

$$\phi_v(t,f)=\frac{\lambda_v(f)p_v(x(t,f);\Theta)}{\sum_n\lambda_n(f)p_n(x(t,f);\Theta)+\lambda_v(f)p_v(x(t,f);\Theta)} \tag{42}$$

Then, a parameter updating unit 202 updates the distribution parameters based on the EM algorithm. At this time, the parameter updating unit 202 sets a cost function for maximum likelihood estimation to the function such as that indicated by Equation (43).

$$\begin{aligned}L(\Theta)&=\log p(x(t,f);\Theta)\\&=\log\sum_n^N\lambda_n(f)N_c(x(t,f);0,r_n(t,f)B_n(f))+\\&\quad\lambda_v(f)N_c(x(t,f);0,r_v(t,f)B_v(f))\end{aligned} \tag{43}$$

Furthermore, the parameter updating unit 202 set the Q function to the function such as that indicated by Equation (44) by using the posterior probability estimated by the posterior probability estimation unit 201.

$$\begin{aligned}Q(\Theta\mid\Theta^t)&=E[\log p(x(t,f),\Theta)\mid\Theta^t]\\&=\sum_n^N\phi_n(t,f)\log\lambda_n(f)N_c(x(t,f);\\&\quad 0,r_n(t,f)B_n(f))+\\&\quad\phi_v(t,f)\log\lambda_v(f)N_c(x(t,f);0,r_v(t,f)B_v(f))\end{aligned} \tag{44}$$

Here, $\Theta^t$ denotes the parameter obtained at a $t^{th}$ repetition update. Furthermore, $\phi_n(t,f)$ and $\phi_v(t,f)$ are given by Equation (36) and Equation (37). The parameter updating unit 202 leads the parameter update rules indicated by Equation (46) to Equation (48) by setting, under the condition indicated by Equation (45), the result obtained by partially differentiating the Q function of Equation (44) with respect to each of the parameters to zero.

$$\sum_n\lambda_n(f)+\lambda_v(f)=1 \tag{45}$$

$$r_n(t,f)=\frac{1}{M}x^H(t,f)B_n^{-1}(f)x(t,f) \tag{46}$$

$$B_n(f)=\frac{\sum_t^T\frac{\phi_n(t,f)}{r_n(t,f)}x(t,f)x^H(t,f)}{\sum_t^T\phi_n(t,f)} \tag{47}$$

$$\lambda_n(f)=\frac{1}{T}\sum_t^T\phi_n(t,f) \tag{48}$$

Consequently, the parameter updating unit 202 updates a distribution parameter Θ. Furthermore, by setting an appropriate prior distribution with respect to Θ, it is possible to implement mask estimation with higher accuracy by using a known method.

Furthermore, the parameter updating unit 202 may also update the distribution parameters online. In this case, the parameter updating unit 202 represents the update rule given by Equation (47) as Equation (49) by using an estimation value $B_n(t'-1,f)$ at time t'−1 that is previous to time t' by one.

$$B_n(t', f) = \frac{\sum_{t}^{t'-1} \phi_n(t, f)}{\sum_{t}^{t'-1} \phi_n(t, f) + \phi_n(t', f)} B_n(t'-1, f) + \frac{\phi_n(t', f)}{\sum_{t}^{t'-1} \phi_n(t', f) + \phi_n(t', f)} \frac{r_n(t', f)}{x(t', f)x^H(t', f)} \tag{49}$$

Furthermore, the parameter updating unit 202 similarly represents the update rule given by Equation (48) as Equation (50).

$$\lambda_n(t', f) = \frac{t'-1}{t'}\lambda_n(t'-1, f) + \frac{1}{t'}\phi_n(t', f) \tag{50}$$

Then, the parameter updating unit 202 copies a new parameter updated by using the update rule into the parameter holding unit 204. Then, the mask estimation unit 20 repeats until the processes of the posterior probability estimation unit 201, the parameter updating unit 202, and the parameter holding unit 204 are performed by the number of determined times (for example, 30 times) or until the calculation results are converged.

Example 3

In Example 3, a description will be given of a method of solving a permutation problem that occurs in the mask estimation method described in Example 2. In Example 2, the mask estimation unit 20 obtains, for each frequency f, the masks $\phi_n(t,f)$ and $\phi_v(t,f)$. However, in the mask estimated by each frequency, there may be a case in which the mask associated with noise is replaced by the mask of the target sound source or the mask associated with the same target sound source is associated, between different frequencies, with a different target sound source number.

Consequently, in order to correctly estimate a spatial correlation matrix for each target sound source, the mask estimation unit 20 needs to correctly determine that which mask is associated with the background noise and needs to associate, between different frequencies, the same target sound source with the corresponding sound source number. Here, this problem is referred to as a permutation problem.

To solve the permutation problem, the mask estimation unit 20 needs to perform the following operations (1) and (2) below.

(1) To determine, in each frequency, which mask is associated with background noise.

(2) To associate, between different frequencies, the mask associated with the same target sound source with the corresponding sound source number.

First, the operation indicated by (1) will be described. At this time, it is assumed that, in each frequency f, N pieces of $B_n(f)$ and one piece of $B_v(f)$ have been obtained in accordance with the method described in Example 2. In the following, to simplify a description, $B_0(f)=B_v(f)$ is used. Here, from among N+1 pieces of $B_v(f)$ ($N \le n \le 0$), the mask estimation unit 20 determines which $B_n(f)$ is associated with the background noise based on (1-1) to (1-3) described below.

(1-1)

To obtain M eigenvalues of $B_n(f)$ for each n and form vectors $\gamma_n(f)$ obtained by sequentially arranging in descending order of the eigenvalues, as indicated by Equation (51).

$$\gamma_n(f)=[\gamma_{n,1}(f),\gamma_{n,1}(f), \ldots ,\gamma_{n,M}(f)] \tag{51}$$

(1-2)

To prepare a function E(·) for evaluating the flatness of the distribution of $\gamma_n(f)$ and obtain, by using Equation (52), the number $n_v$ associated with the greatest value of n.

$$n_v=\arg\max E(\gamma_n(f)) \tag{52}$$

(1-3)

To determine the mask associated with $n_v$ as the mask associated with the background noise. Regarding a method of determining E(·), for example, as indicated by Equation (53), as the function for obtaining entropy of $\gamma_n(f)$ that is normalized to be 1 by adding the element of the vector, Equation (54) can be defined.

$$\gamma_n(f) \Big/ \sum_{m-1}^{M} \gamma_{n,m}(f) \tag{53}$$

$$E(\gamma_n(f)) = H\left(\frac{\gamma_n(f)}{\sum_{m=0}^{M} \lambda_{n,m}(f)}\right) = -\sum_{m=1}^{M} \frac{\gamma_{n,m}(f)}{\sum_{m=0}^{M} \gamma_{n,m}(f)} \log \frac{\gamma_{n,m}(f)}{\sum_{m=0}^{M} \gamma_{n,m}(f)} \tag{54}$$

Here, H(·) is a function for obtaining entropy of vector $u=[u_1, u_2, \ldots, u_M]$ that becomes 1 after adding an element and is defined as Equation (55).

$$H(u) = -\sum_{m=1}^{M} u_m \log u_m \tag{55}$$

In the following, the operation indicated by (2) will be described. First, regarding the estimated N masks, the mask estimation unit 20 needs to associate, in all of the frequencies, the mask $\phi_n(t,f)$ associated with the same target sound source n with the corresponding number n of the same target sound source. As a specific method, the following (2-1) to (2-4) can be conceived.

(2-1)

It is assumed that that number of persons N participating in a conversation is a known number and the mask estimation unit 20 sets N masks except for the mask of the background noise from among the masks estimated by the method described in Example 2 to $\phi_n(t,f)$ (n=1, . . . , N).

Here, because the mask is used to represent the proportion indicating that how much target signal is included in each time-frequency point, the time series of the mask of a certain single sound source tends to synchronize in all frequencies. By using this property, the mask estimation unit 20 solves the permutation problem by clustering the time series $\phi_n(t,f)$ (t=1, . . . , T) of the obtained masks of n and f into N clusters. For the clustering, for example, the k-means algorithm may be used or the method described in a reference 1 (H. Sawada, S. Araki, S. Makino, "Underdetermined Convolutive Blind Source Separation via Frequency Bin-Wise Clustering and Permutation Alignment", IEEE Trans. Audio, Speech, and Language Processing, vol. 19, no. 3, pp. 516-527, March 2011.) may be used.

(2-2)

When estimating the masks by using Equation (41) and Equation (42), the mask estimation unit 20 fixes $B_n(f)$ to a spatial correlation matrix $B_n^{trained}(f)$ that is previously learned for each location of a talker. $B_n^{trained}(f)$ is $B_n(f)$ obtained, as the result of Equation (47), by previously preparing, for example, an observation signal of a talker obtained at each location as learning data and estimating masks of the learning data by using the method described in Example 2.

This procedure is effective for a conversation held in a conference room in which the positions of chairs are almost fixed and, with this procedure, it is possible to estimate the mask $\phi_n(t,f)$ associated with a talker associated with each seat as the target sound source n.

(2-3)

In a procedure (2-3), the mask estimation unit 20 sets, in a procedure (2-2), the initial value of $B_n(f)$ to $B_n^{trained}(f)$ and estimates the masks by using the method described in Example 2. The procedure (2-2) is effective for a case in which the positions of chairs are almost fixed but the position of a talker is slightly changed during conversation due to casters attached to the chair.

(2-4)

In a procedure (2-4), the mask estimation unit 20 estimates the masks by using $B_n^{trained}(f)$ as prior information of $B_n(f)$. Specifically, the mask estimation unit 20 estimates Equation (47) by using Equation (56), where η (real numbers from 0 to 1) denotes weight.

$$B_n(f) = \eta \frac{\sum_t \frac{\phi_n(t,f)}{r_n(t,f)} x(t,f) x^H(t,f)}{\sum_t \phi_n(t,f)} + (1-\eta) B_n^{trained}(f) \tag{56}$$

The procedure (2-3) is effective for a case in which, similarly to the procedure (2-2), the positions of chairs are almost fixed but the position of a talker is slightly changed during conversation due to casters attached to the chair.

Example 4

As Example 4, a description will be given of a case in which direction estimation is performed by using a spatial correlation matrix of the target sound sources obtained by the spatial correlation matrix estimation device 1. First, it is assumed that a steering vector related to the sound source n has been obtained, as indicated by Equation (57), by using the same process as that described in Example 1.

$$h_n(f)=[h_{n1}, \ldots, h_{nm}, \ldots, h_{nM}]^T (m \text{ is a mike number}) \tag{57}$$

Then, as described in a reference 2 (S. Araki, H. Sawada, R. Mukai and S. Makino, "DOA estimation for multiple sparse sources with normalized observation vector clustering", ICASSP2006, Vol. 5, pp. 33-36, 2006.), if it is assumed that arrangement of M mikes have already been known, the three-dimensional coordinates of a mike m is $d_m$, the azimuth angle of the sound source n viewed from a mike array is $\theta_n$, and an elevation angle is $\varphi_n$, it is possible to calculate $q_n=[\cos(\theta_n)\cos(\varphi_n), \cos(\theta_n)\sin(\varphi_n), \sin(\varphi_n)]^T$ by using Equation (58).

$$q_n(f) = \frac{c}{2\pi \bar{f}} D + \xi_n(f) \tag{58}$$

where, c denotes a velocity of sound, f bar denotes the frequency (Hz) associated with the frequency index f, $\xi n(f)=[\arg(h_{n1}/h_{nJ}), \ldots, \arg(h_{nM}/h_{nJ})]^T$, $D=[d_1-d_J, \ldots, d_M-d_J]^T$, J denotes the index (arbitrarily select from 1 to M) of the reference mike, and + denotes a generalized inverse matrix.

Then, regarding the arrival direction $q_n(f)$ obtained by Equation (58), the average value of frequency range of $q_n(f)$ in which spatial aliasing does not occur is set to arrival direction q, of the sound source n. Furthermore, instead of q, the average value of the azimuth angle, the elevation angle, or the like may also be calculated.

Process in the First Embodiment

Figure 3:
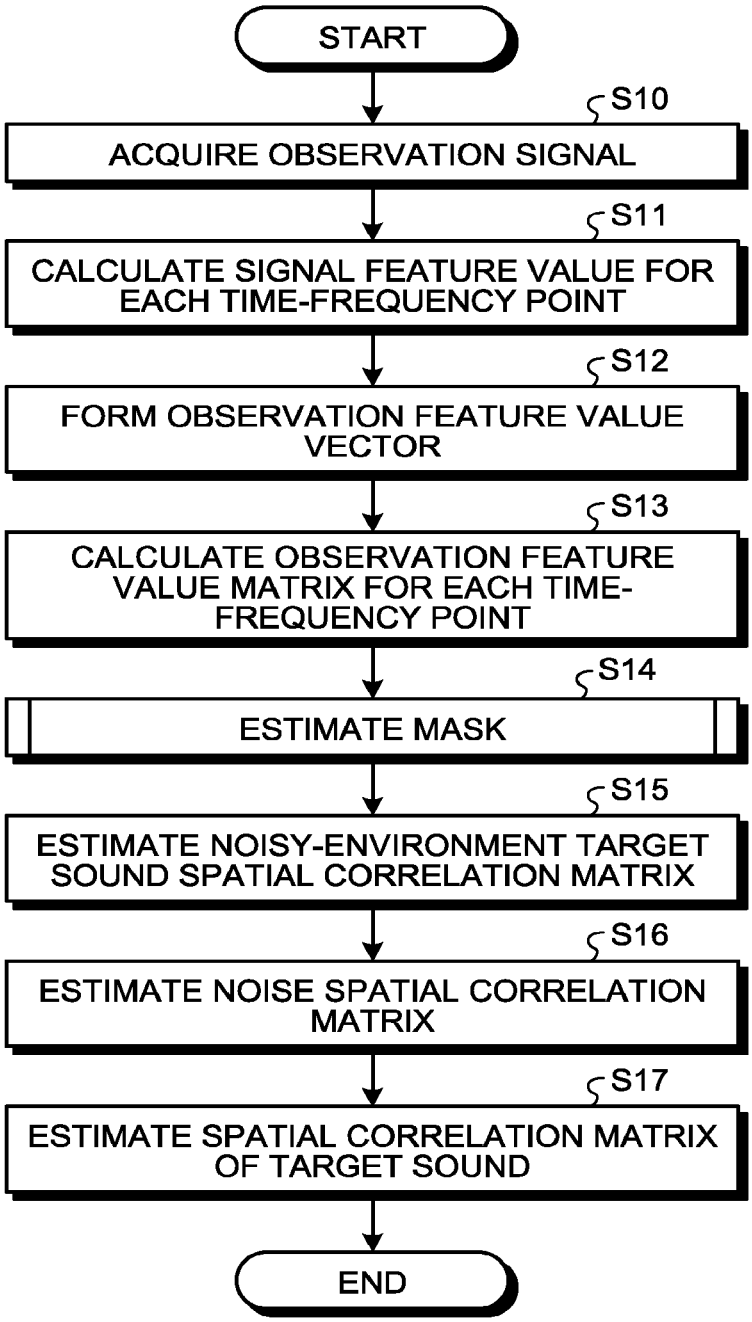
FIG. 3 is a diagram illustrating an example of a process performed by the spatial correlation matrix estimation device according to the first embodiment.

The process performed by the spatial correlation matrix estimation device 1 according to the first embodiment will be described with reference to FIG. 3. FIG. 3 is a diagram illustrating an example of a process performed by the spatial correlation matrix estimation device according to the first embodiment. First, as illustrated in FIG. 3, the time-frequency analysis unit 10 acquires observation signals (Step S10), calculates a signal feature value for each time-frequency point by using a short-time signal analysis, such as short-time Fourier transformation (Step S11) and forms observation feature value vectors (Step S12).

Then, the observation feature value matrix calculation unit 30 calculates, based on the observation feature value vectors, an observation feature value matrix for each time-frequency point (Step S13). Then, the mask estimation unit 20 estimates the mask based on the observation feature value vectors (Step S14).

The noisy-environment target sound spatial correlation matrix estimation unit 40 estimates a noisy-environment target sound spatial correlation matrix by applying the mask associated with the target sound to the observation feature value matrix and performs weighting by using a predetermined coefficient (Step S15). Furthermore, the noise spatial correlation matrix estimation unit 50 estimates a noise spatial correlation matrix by applying the mask associated with the background noise to the observation feature value matrix and performs weighting by using a predetermined coefficient (Step S16).

At this time, the ratio of the coefficient used to estimate the noisy-environment target sound spatial correlation matrix to the coefficient used to estimate the noise spatial correlation matrix is equal to the ratio of, for example, the reciprocal of the time average of the mask associated with the target sound to the reciprocal of the time average of the mask of the background noise.

Lastly, the target sound spatial correlation matrix noise removal unit 60 estimates a spatial correlation matrix of the target sound by subtracting, for example, the noise spatial correlation matrix from the noisy-environment target sound spatial correlation matrix (Step S17).

Figure 4:
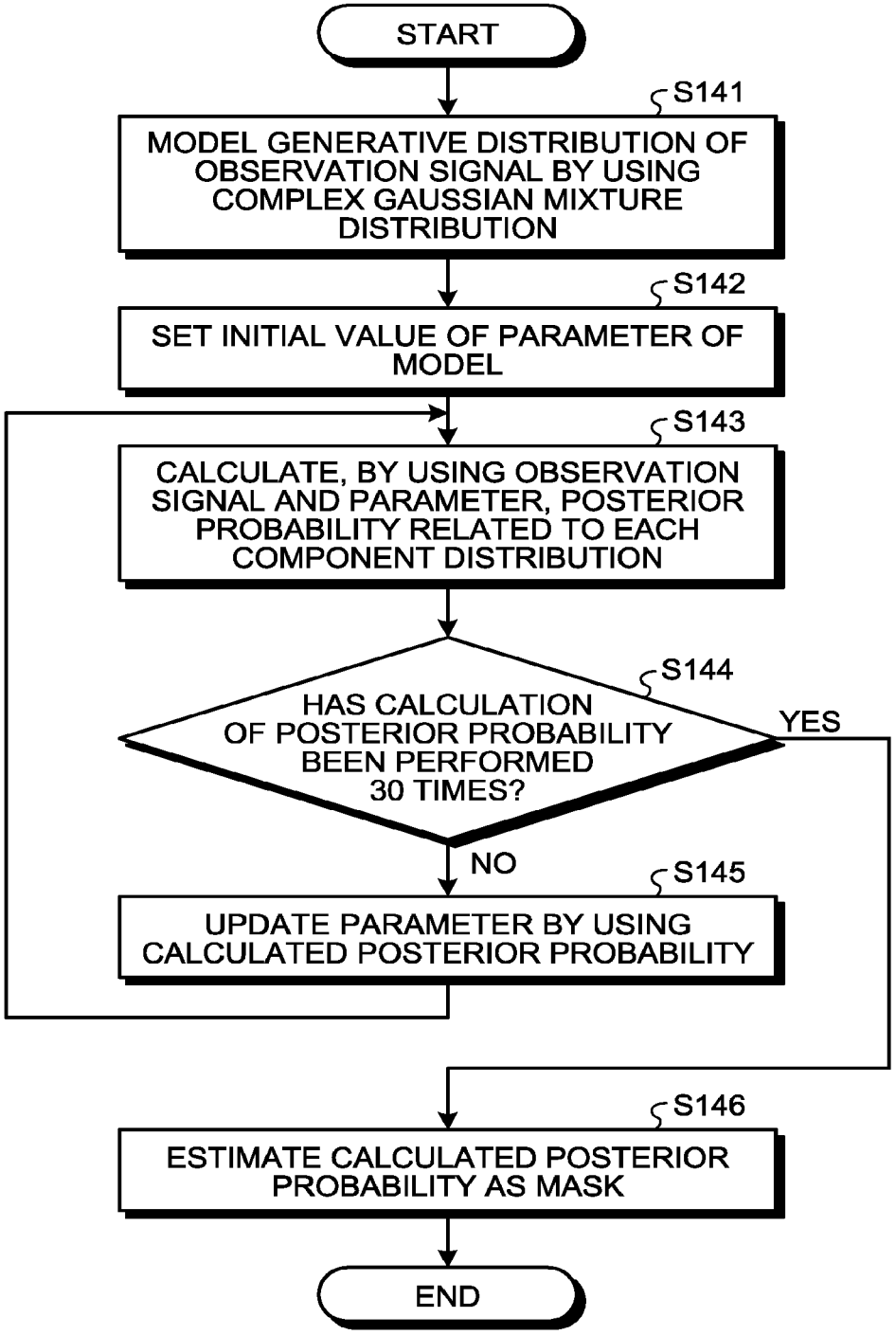
FIG. 4 is a diagram illustrating an example of a mask estimation process performed by the spatial correlation matrix estimation device according to the first embodiment.

Furthermore, an example of the mask estimation process performed at Step S14 illustrated in FIG. 3 will be described with reference to FIG. 4. FIG. 4 is a diagram illustrating an example of a mask estimation process performed by the spatial correlation matrix estimation device according to the first embodiment. First, the mask estimation unit 20 models a generative distribution of the observation signals by using a complex Gaussian mixture distribution (Step S141).

The parameter initialization unit 203 sets the initial value of the parameters of the model by using random numbers or the like (Step S142). Then, the posterior probability estimation unit 201 calculates, by using the observation signals and the parameters, a posterior probability related to each component distribution (Step S143). Here, if calculation of the posterior probability has not been performed 30 times (No at Step S144), the parameter updating unit 202 updates the parameters by using the calculated posterior probability (Step S145). Furthermore, the mask estimation unit 20 returns to Step S143 and repeats the process.

Then, if the calculation of the posterior probability has been performed 30 times (Yes at Step S144), the parameter updating unit 202 performs the last parameter update process. Lastly, the mask estimation unit 20 estimates the calculated posterior probability as the masks (Step S146).

Effect of the First Embodiment

To validate the effects of the present invention, validation experiments performed by using a conventional method and the first embodiment will be described.

(Validation Experiment 1)

In Validation Experiment 1, in an environment in which background noise is present, such as in a bus or cafe, in a situation in which a single talker (N=1) reads out a sentence toward tablets, signals are recorded by using M mikes (M=6) attached to the tablets. At this time, regarding the recorded signals, the accuracy of speech recognition in the case where speech recognition has been performed by using each of the methods is as follows. Based on the results described below, by applying the first embodiment, an improvement in the accuracy of speech recognition has been validated.

(1) In the case where speech recognition was performed without processing anything: 87.11 (%)
(2) In the case where MVDR was applied after performing mask estimation in the Watson distribution (conventional method): 89.40 (%)
(3) In the case where MVDR was applied after applying the first embodiment and then performing mask estimation offline (Example 1, offline): 91.54 (%)
(4) In the case where MVDR is applied after applying the first embodiment and then performing mask estimation online by using the previously learned parameters as the initial values (Example 1, online): 91.80 (%)

(Validation Experiment 2)

In Validation Experiment 2, in a general conference room, in a situation in which four talkers (N=4) are freely talking around a round table with a diameter of 1.2 m, signals are recorded by using M mikes (M=8) placed at the center of the round table. At this time, regarding the recorded signals, the accuracy of speech recognition in the case where speech recognition has been performed by using each of the methods is as follows. Based on the results described below, by applying the first embodiment, an improvement in the accuracy of speech recognition has been validated.

(1) In the case where speech recognition was performed without processing anything: 20.9 (%)
(2) In the case where MVDR was applied after applying the first embodiment and then performing mask estimation offline (Example 1, offline): 54.0 (%)
(3) In the case where MVDR was applied after applying the first embodiment and then performing mask estimation online (Example 1, online): 52.0 (%)

The time-frequency analysis unit 10 calculates the observation feature value vectors based on the input observation feature values. Furthermore, the mask estimation unit 20 estimates the first mask that is the proportion of the first acoustic signal included in the feature value of the observation signal for each time-frequency point and estimates the second mask that is the proportion of the second acoustic signal included in the feature value of the observation signal for each time-frequency point. Then, the observation feature value matrix calculation unit 30 calculates, based on the observation feature value vectors, for each time-frequency point, the observation feature value matrix by multiplying an observation feature value vector by Hermitian transpose of the subject observation feature value vector.

The noisy-environment target sound spatial correlation matrix estimation unit 40 calculates the first spatial correlation matrix by weighting the first feature value matrix, which is calculated based on the observation signals and the first masks, by the first coefficient. Furthermore, the noise spatial correlation matrix estimation unit 50 calculates the second spatial correlation matrix by weighting the second feature value matrix, which is calculated based on the observation signals and the second masks, by the second coefficient. Then, the target sound spatial correlation matrix noise removal unit 60 estimates the spatial correlation matrix of the target sound sources based on the first spatial correlation matrix and the second spatial correlation matrix.

In this way, according to the first embodiment, because appropriate weighting has been performed by the first coefficient and the second coefficient, compared with a case in which the first feature value matrix and the second feature value matrix are used without processing anything, it is possible to accurately remove the effect of background noise from an observation signals and estimate a spatial correlation matrix of the target sound sources with high accuracy.

Furthermore, the ratio of the first coefficient to the second coefficient may also be equal to the ratio of, for example, the reciprocal of the time average value of the first mask to the reciprocal of the time average value of the second mask. Consequently, information indicating that the spatial correlation matrix of the background noise is not significantly changed in terms of time is contained in the spatial correlation matrix of the target sound sources to be estimated, thus improving the estimation accuracy.

Furthermore, the mask estimation unit 20 models, for each frequency, the probability distribution of the observation feature value vectors by a mixture distribution composed of N+1 component distributions each of which is a zero mean M-dimensional complex Gaussian distribution with a covariance matrix represented by the product of a scalar parameter that has a time varying value and a positive definite Hermitian matrix that has time invariant parameters as its elements.

Then, the mask estimation unit 20 sets, to the first mask and the second mask, each of posterior probabilities of the component distributions obtained by estimating the parameters of the mixture distributions such that the mixture distributions approach the distribution of the observation feature value vectors. Consequently, even if the shape of the distribution of the observation feature value vectors is not accurately approximated on a circle on a hypersphere, it is possible to accurately estimate the masks.

The mask estimation unit 20 further sets, to the second mask associated with background noise, from among the component distributions, the posterior probability of the component distribution that has the most flat shape of the distribution of the eigenvalues of the positive definite Hermitian matrix that has the time invariant parameters as the elements. Consequently, it is possible to automatically estimate which mask is associated with the background noise from among the masks estimated by the mask estimation unit.

[System Configuration]

The components of each device illustrated in the drawings are only for conceptually illustrating the functions thereof and are not always physically configured as illustrated in the drawings. In other words, the specific shape of a separation or integrated device is not limited to the drawings. Specifically, all or part of the device can be configured by functionally or physically separating or integrating any of the units depending on various loads or use conditions. Furthermore, all or any part of each of the processing functions performed by the processing units can be implemented by a central processing unit (CPU) and by programs analyzed and executed by the CPU or implemented as hardware by wired logic.

Of the processes described in the embodiment, the whole or a part of the processes that are mentioned as being automatically performed can also be manually performed, or the whole or a part of the processes that are mentioned as being manually performed can also be automatically performed using known methods. Furthermore, the flow of the processes, the control procedures, the specific names, and the information containing various kinds of data or parameters indicated in the above specification and drawings can be arbitrarily changed unless otherwise stated.

[Program]

As an embodiment, the spatial correlation matrix estimation device can be mounted by installing, in a desired computer, a spatial correlation matrix estimation program that executes the spatial correlation matrix estimation described above as packaged software or online software. For example, by executing the spatial correlation matrix estimation program described above by an information processing apparatus, it is possible to allow the information processing apparatus to function as the spatial correlation matrix estimation device. An example of the information processing apparatus mentioned here includes a desktop or a notebook personal computer. Furthermore, other than this, an example of the information processing apparatus includes a mobile communication terminal, such as smartphone, a mobile phone, or Personal Handyphone System (PHS), and a slate terminal, such as a Personal Digital Assistant (PDA).

Furthermore, the spatial correlation matrix estimation device can also be mounted as a server device, together with a terminal device used by a user as a client, that provides a service related to the spatial correlation matrix estimation described above to the client. For example, the spatial correlation matrix estimation device is mounted as a server device that provides a spatial correlation matrix estimation service for inputting observation signals and outputting a spatial correlation matrix of the target sound sources. In this case, the spatial correlation matrix estimation device may also be mounted as a Webserver or mounted as a cloud or mounted so as to provide a service related to the spatial correlation matrix estimation described above by outsourcing.

Figure 5:
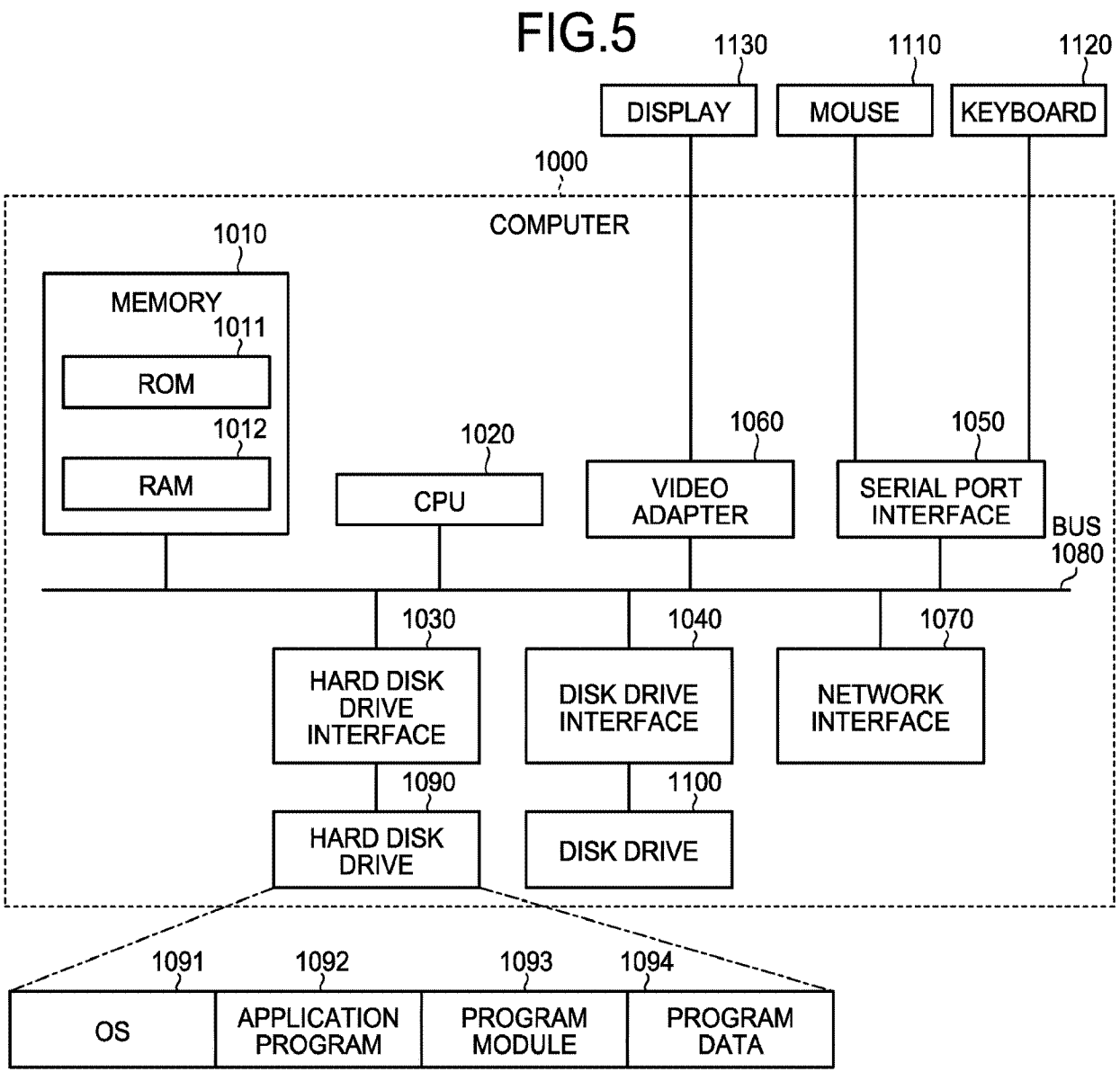
FIG. 5 is a diagram illustrating an example of a computer used to implement the spatial correlation matrix estimation device by executing a program.
Figure 6:
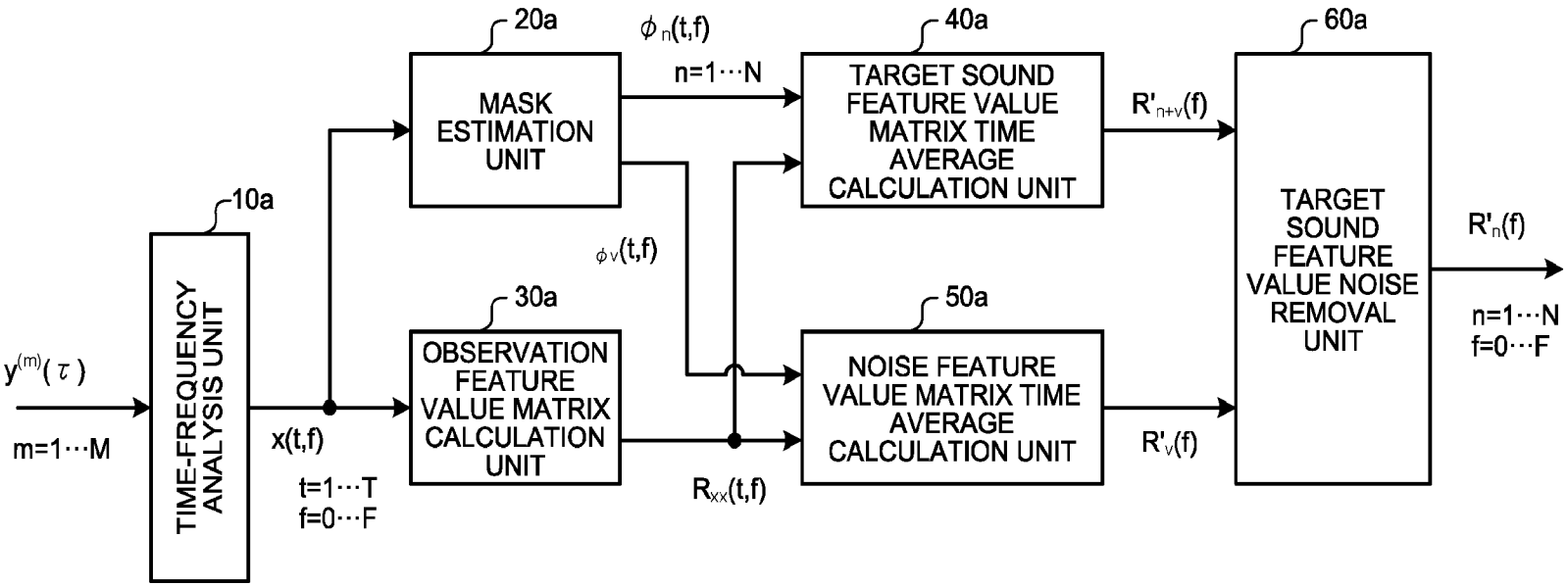
FIG. 6 is a diagram illustrating the configuration of a conventional spatial correlation matrix estimation device.

FIG. 5 is a diagram illustrating an example of a computer used to implement the spatial correlation matrix estimation device by executing a program. A computer 1000 includes, for example, a memory 1010 and a CPU 1020. Furthermore, the computer 1000 includes a hard disk drive interface 1030, a disk drive interface 1040, a serial port interface 1050, a video adapter 1060, and a network interface 1070. Each of the units is connected by a bus 1080.

The memory 1010 includes a read only memory (ROM) 1011 and a random access memory (RAM) 1012. The ROM 1011 stores therein a boot program, such as Basic Input Output System (BIOS). The hard disk drive interface 1030 is connected to a hard disk drive 1090. The disk drive interface 1040 is connected to a disk drive 1100. For example, an attachable and detachable storage medium, such as a magnetic disk or an optical disk, is inserted into the disk drive 1100. The serial port interface 1050 is connected to, for example, a mouse 1110 and a keyboard 1120. The video adapter 1060 is connected to, for example, a display 1130.

The hard disk drive 1090 stores therein, for example, an OS 1091, an application program 1092, a program module 1093, and a program data 1094. Namely, the program that determine each of the processes performed by the spatial correlation matrix estimation device 1 is installed as the program module 1093 in which codes that can be executed by a computer are described. The program module 1093 is stored in, for example, the hard disk drive 1090. For example, the program module 1093 that is used to execute the same process as that of the functional configuration of the spatial correlation matrix estimation device 1 is stored in the hard disk drive 1090. The hard disk drive 1090 may also be replaced by a solid state drive (SSD).

Furthermore, the setting data used in the process performed in the above described embodiment is stored in, as the program data 1094, for example, the memory 1010 or the hard disk drive 1090. Then, the CPU 1020 reads, to the RAM 1012 as needed, the program module 1093 or the program data 1094 stored in the memory 1010 or the hard disk drive 1090.

Furthermore, instead of the hard disk drive 1090, the program module 1093 and the program data 1094 may also be stored in, for example, a removable storage medium and read by the CPU 1020 via the disk drive 1100 or the like. Alternatively, the program module 1093 and the program data 1094 may also be stored in another computer connected via a network (a local area network (LAN), a wide area network (WAN), etc.). Then, the program module 1093 and the program data 1094 may also be read, from the computer, by the CPU 1020 via the network interface 1070.

REFERENCE SIGNS LIST

1 spatial correlation matrix estimation device
10 time-frequency analysis unit
20 mask estimation unit
30 observation feature value matrix calculation unit
40 noisy-environment target sound spatial correlation matrix estimation unit
50 noise spatial correlation matrix estimation unit
60 target sound spatial correlation matrix noise removal unit
201 posterior probability estimation unit
202 parameter updating unit
203 parameter initialization unit
204 parameter holding unit

The invention claimed is:

1. A non-transitory spatial correlation matrix estimation device comprising:

a memory; and a processor coupled to the memory and programmed to execute a process comprising:

estimating, in a situation in which N first acoustic signals associated with N target sound sources (where, N is an integer equal to or greater than 1) and a second acoustic signal associated with background noise are present in a mixed manner, based on observation feature value vectors calculated based on M observation signals (where, M is an integer equal to or greater than 2) each of which is recorded at a different position, a first mask that is the proportion of the first acoustic signal included in a feature value of the observation signal for each time-frequency point and a second mask that is the proportion of the second acoustic signal included in a feature value of the observation signal for each time-frequency point and that estimates a spatial correlation matrix of the target sound sources based on the first mask and the second mask, wherein the estimating estimates the spatial correlation matrix of the target sound sources based on a first spatial correlation matrix obtained by weighting, by a first coefficient, a first feature value matrix calculated based on the observation signals and the first masks and based on a second spatial correlation matrix obtained by weighting, by a second coefficient, a second feature value matrix calculated based on the observation signals and the second masks.

2. The spatial correlation matrix estimation device according to claim 1, wherein the estimating calculates the first coefficient and the second coefficient such that, under the condition that a spatial correlation matrix of background noise is not temporally changed, a component derived from the background noise included in an estimation value of the spatial correlation matrix of the target sound sources becomes zero.

3. The spatial correlation matrix estimation device according to claim 1, wherein the estimating calculates the first coefficient and the second coefficient such that the ratio of the first coefficient to the second coefficient is equal to the ratio of the reciprocal of a time average value of the first masks to the reciprocal of a time average value of the second masks.

4. The spatial correlation matrix estimation device according to claim 1, wherein, when N=1, the first spatial correlation matrix is a time average, for each frequency, of an observation feature value matrix calculated based on the observation feature value vectors.

5. The spatial correlation matrix estimation device according to claim 1, further comprising:

applying a short-time signal analysis to the observation signals, extracting a signal feature value for each time-frequency point, and calculating, for each time-frequency point, the observation feature value vector that is an M-dimensional column vector having the signal feature value as a component;

calculating, based on the observation feature value vector, for each time-frequency point, an observation feature value matrix by multiplying the observation feature value vector by Hermitian transpose of the observation feature value vector;

calculating, regarding each of the target sound sources, the time average, for each frequency, of a matrix obtained by multiplying, for each time-frequency point, the observation feature value matrix by the first mask as the first feature value matrix and that estimates the first spatial correlation matrix by multiplying the first coefficient by the first feature value matrix; and calculating, regarding the background noise, the time average, for each frequency, of a matrix obtained by multiplying, for each time-frequency point, the observation feature value matrix by the second mask as the second feature value matrix and estimating the second spatial correlation matrix by multiplying the second coefficient by the second feature value matrix, wherein the spatial correlation matrix of the target sound sources being estimated by subtracting the second spatial correlation matrix from the first spatial correlation matrix, and the ratio of the first coefficient to the second coefficient is equal to the ratio of the reciprocal of the time average value of the first mask to the reciprocal of the time average value of the second mask.

6. The spatial correlation matrix estimation device according to claim 1, further comprising modeling, for each frequency, a probability distribution of the observation feature value vectors by a mixture distribution composed of N+1 component distributions each of which is a zero mean M-dimensional complex Gaussian distribution with a covariance matrix represented by the product of a scalar parameter that has a time varying value and a positive definite Hermitian matrix that has time invariant parameters as its elements and setting, to the first mask and the second mask, each of posterior probabilities of the component distributions obtained by estimating the parameters of the mixture distributions such that the mixture distributions approach the distribution of the observation feature value vectors.

7. The spatial correlation matrix estimation device according to claim 6, wherein, from among the component distributions, estimating sets, to the second mask, the posterior probability of an component distribution that has the most flat shape of the distribution of eigenvalues of the positive definite Hermitian matrix that has the time invariant parameters as the elements.

8. A spatial correlation matrix estimation method for estimating, in a situation in which N first acoustic signals associated with N target sound sources (where, N is an integer equal to or greater than 1) and a second acoustic signal associated with background noise are present in a mixed manner, based on observation feature value vectors calculated based on M observation signals (where, M is an integer equal to or greater than 2) each of which is recorded at a different position, a first mask that is the proportion of the first acoustic signal included in a feature value of the observation signal for each time-frequency point and a second mask that is the proportion of the second acoustic signal included in a feature value of the observation signal for each time-frequency point and estimating a spatial correlation matrix of the target sound sources based on the first mask and the second mask, the spatial correlation matrix estimation method comprising:

a noise removal step of estimating the spatial correlation matrix of the target sound sources based on a first spatial correlation matrix obtained by weighting, by a first coefficient, a first feature value matrix calculated based on the observation signals and the first masks and based on a second spatial correlation matrix obtained by weighting, by a second coefficient, a second feature value matrix calculated based on the observation signals and the second masks.

9. The spatial correlation matrix estimation method according to claim 8, wherein the noise removal step includes calculating the first coefficient and the second coefficient such that, under the condition that a spatial correlation matrix of background noise is not temporally changed, a component derived from the background noise included in an estimation value of the spatial correlation matrix of the target sound sources becomes zero.

10. The spatial correlation matrix estimation method according to claim 8, wherein the noise removal step includes calculating the first coefficient and the second coefficient such that the ratio of the first coefficient to the second coefficient is equal to the ratio of the reciprocal of a time average value of the first masks to the reciprocal of a time average value of the second masks.

11. The spatial correlation matrix estimation method according to claim 8, further comprising:

a time-frequency analyzing step of applying a short-time signal analysis to the observation signals, extracting a signal feature value for each time-frequency point, and calculating, for each time-frequency point, the observation feature value vector that is an M-dimensional column vector having the signal feature value as a component;

an observation feature value matrix calculating step of calculating, based on the observation feature value vector, for each time-frequency point, an observation feature value matrix by multiplying the observation feature value vector by Hermitian transpose of the observation feature value vector;

a noisy-environment target sound spatial correlation matrix estimating step of calculating, regarding each of the target sound sources, the time average, for each frequency, of a matrix obtained by multiplying, for each time-frequency point, the observation feature value matrix by the first mask as the first feature value matrix and estimating the first spatial correlation matrix by multiplying the first coefficient by the first feature value matrix; and a noise spatial correlation matrix estimating step of calculating, regarding the background noise, the time average, for each frequency, of a matrix obtained by multiplying, for each time-frequency point, the observation feature value matrix by the second mask as the second feature value matrix and estimating the second spatial correlation matrix by multiplying the second coefficient by the second feature value matrix, wherein the noise removal step includes estimating the spatial correlation matrix of the target sound sources by subtracting the second spatial correlation matrix from the first spatial correlation matrix, and the ratio of the first coefficient to the second coefficient is equal to the ratio of the reciprocal of the time average value of the first mask to the reciprocal of the time average value of the second mask.

12. A non-transitory computer-readable recording medium having stored a spatial correlation matrix estimation program that causes a spatial correlation matrix estimation device to estimate, in a situation in which N first acoustic signals associated with N target sound sources (where, N is an integer equal to or greater than 1) and a second acoustic signal associated with background noise are present in a mixed manner, based on observation feature value vectors calculated based on M observation signals (where, M is an integer equal to or greater than 2) each of which is recorded at a different position, a first mask that is the proportion of the first acoustic signal included in a feature value of the observation signal for each time-frequency point and a second mask that is the proportion of the second acoustic signal included in a feature value of the observation signal for each time-frequency point and that estimates a spatial correlation matrix of the target sound sources based on the first mask and the second mask, and to estimate the spatial correlation matrix of the target sound sources based on a first spatial correlation matrix obtained by weighting, by a first coefficient, a first feature value matrix calculated based on the observation signals and the first masks and based on a second spatial correlation matrix obtained by weighting, by a second coefficient, a second feature value matrix calculated based on the observation signals and the second masks.

* * * * *